US007284461B2

(12) United States Patent
Skrobis et al.

(10) Patent No.: US 7,284,461 B2
(45) Date of Patent: Oct. 23, 2007

(54) COLORED RAZOR BLADES

(75) Inventors: Kenneth J. Skrobis, Maynard, MA (US); Alfred Porcaro, Everett, MA (US); Ronald J. Swanson, Norwell, MA (US); Eric Liu, Lexington, MA (US)

(73) Assignee: The Gillette Company, Boston, MA (US)

( * ) Notice: Subject to any disclaimer, the term of this patent is extended or adjusted under 35 U.S.C. 154(b) by 250 days.

(21) Appl. No.: 11/013,827

(22) Filed: Dec. 16, 2004

(65) Prior Publication Data

US 2006/0130612 A1 Jun. 22, 2006

(51) Int. Cl.
*C21D 1/18* (2006.01)
*B21K 11/00* (2006.01)

(52) U.S. Cl. ..... 76/104.1; 148/284; 148/287

(58) Field of Classification Search ..... 76/104.1; 30/346.53, 346.54; 148/284, 285, 287
See application file for complete search history.

(56) References Cited

U.S. PATENT DOCUMENTS

| | | | | |
|---|---|---|---|---|
| 188,159 | A | 3/1877 | McAllister | |
| 1,092,925 | A | 4/1914 | Machlet | |
| 1,734,554 | A | 11/1929 | Behrman | |
| 1,736,920 | A | 11/1929 | Kinzel | |
| 1,748,378 | A | 2/1930 | Armstrong | |
| 1,772,866 | A | 8/1930 | Hirsch | |
| 1,887,504 | A | 11/1932 | Frost | |
| 2,032,963 | A * | 3/1936 | Voltmann | 148/287 |
| 2,073,501 | A * | 3/1937 | Stargardter | 148/284 |
| 2,073,502 | A * | 3/1937 | Stargardter | 30/346.53 |
| 2,131,505 | A * | 9/1938 | Garsson | 148/633 |
| 2,137,817 | A * | 11/1938 | Tuerff | 148/284 |
| 3,652,342 | A | 3/1972 | Fischbein et al. | 148/6.35 |
| 3,664,884 | A * | 5/1972 | Underwood | 148/242 |
| 3,754,329 | A | 8/1973 | Lane | 30/346.53 |
| 3,774,703 | A * | 11/1973 | Sanderson | 428/600 |
| 3,879,844 | A | 4/1975 | Griffiths | 30/34 |
| 4,012,551 | A | 3/1977 | Bogaty et al. | 428/192 |
| 4,022,947 | A | 5/1977 | Grubb et al. | 428/432 |
| 4,234,776 | A * | 11/1980 | Rudd et al. | 219/76.17 |
| 4,281,456 | A | 8/1981 | Douglass et al. | 30/89 |
| 4,453,987 | A | 6/1984 | Arai et al. | 148/15.5 |
| 4,586,255 | A | 5/1986 | Jacobson | 30/41 |
| 4,933,058 | A | 6/1990 | Bache et al. | 204/192.3 |
| 4,981,756 | A | 1/1991 | Rhandhawa et al. | |
| 5,032,243 | A | 7/1991 | Bache et al. | 204/192.34 |

(Continued)

FOREIGN PATENT DOCUMENTS

DE 3533238 A1 3/1987

(Continued)

*Primary Examiner*—Hwei-Siu C. Payer
(74) *Attorney, Agent, or Firm*—Dara M. Kendall; Kevin C. Johnson; Steve W. Miller

(57) ABSTRACT

Colored razor blades are provided. Methods for manufacturing such blades are also provided, including methods involving subjecting a blade material to a hardening process; and, during the hardening process, oxidizing the blade material to form an oxide layer on the blade material. The method also includes quenching the blade material, after the oxidizing step, to initiate martensitic transformation of the blade material, and forming the hardened blade material into a razor blade, the oxide layer providing the razor blade with a colored surface.

18 Claims, 5 Drawing Sheets

U.S. PATENT DOCUMENTS

| | | | | |
|---|---|---|---|---|
| 5,232,568 | A | 8/1993 | Parent et al. | 204/192.3 |
| 5,236,439 | A | 8/1993 | Kozikowski | 30/50 |
| 5,263,256 | A | 11/1993 | Trankiem | 30/346.54 |
| 5,295,305 | A | 3/1994 | Hahn et al. | 30/50 |
| 5,305,526 | A * | 4/1994 | Althaus | 30/77 |
| 5,458,025 | A | 10/1995 | Neamtu | 76/104.1 |
| 5,477,756 | A | 12/1995 | Trankiem et al. | 76/104.1 |
| 5,497,550 | A | 3/1996 | Trotta et al. | 30/50 |
| 5,531,401 | A | 7/1996 | Newcomb | 244/31 |
| 5,543,183 | A | 8/1996 | Streckert et al. | 427/529 |
| 5,603,161 | A | 2/1997 | Welsh | 30/41.7 |
| 5,669,144 | A | 9/1997 | Hahn et al. | 30/346.54 |
| 5,701,788 | A | 12/1997 | Wilson et al. | 76/104.1 |
| 5,794,354 | A | 8/1998 | Gilder | 30/530 |
| 5,918,369 | A | 7/1999 | Apprille, Jr. et al. | 30/47 |
| 5,940,975 | A | 8/1999 | Decker et al. | 30/346.54 |
| 5,985,459 | A | 11/1999 | Kwiecien et al. | 428/421 |
| 6,272,061 | B1 | 8/2001 | Kato et al. | 365/225.7 |
| 6,436,546 | B1 | 8/2002 | Gulikers et al. | 428/469 |
| 6,684,513 | B1 * | 2/2004 | Clipstone et al. | 30/346.54 |

FOREIGN PATENT DOCUMENTS

| | | |
|---|---|---|
| GB | 1 416 887 | 12/1975 |
| WO | WO 92/19425 | 11/1992 |
| WO | WO 92/21286 | 12/1992 |
| WO | WO 2005/120783 A1 | 5/2005 |

* cited by examiner

COLORED RAZOR BLADES

TECHNICAL FIELD

This invention relates to razor blades and processes for manufacturing razor blades, and more particularly to colored razor blades.

BACKGROUND

Razor blades are typically formed of a suitable metallic sheet material such as stainless steel, which is slit to a desired width and heat-treated to harden the metal. The hardening operation utilizes a high temperature furnace, where the metal may be exposed to temperatures greater than 110° C. for up to 10 seconds, followed by quenching.

After hardening, a cutting edge is formed on the blade. The cutting edge typically has a wedge-shaped configuration with an ultimate tip having a radius less than about 1000 angstroms, e.g., about 200-300 angstroms.

Various coatings may be applied to the cutting edge. For example, hard coatings such as diamond, amorphous diamond, diamond-like carbon (DLC) material, nitrides, carbides, oxides or ceramics are often applied to the cutting edge or the ultimate tip to improve strength, corrosion resistance and shaving ability. Interlayers of niobium or chromium containing materials can aid in improving the binding between the substrate, typically stainless steel, and the hard coatings. A polytetrafluoroethylene (PTFE) outer layer can be used to provide friction reduction.

It is important that these coatings be applied, and any other post-hardening processing steps be performed, under sufficiently low temperature conditions so that the hardened, sharpened steel is not tempered. If the steel is tempered it will lose its hardness and may not perform properly during use.

Examples of razor blade cutting edge structures and processes of manufacture are described in U.S. Pat. Nos. 5,295,305; 5,232,568; 4,933,058; 5,032,243; 5,497,550; 5,940,975; 5,669,144; EP 0591334; and PCT 92/03330, which are hereby incorporated by reference.

SUMMARY

The present invention provides razor blades that include a colored oxide layer, i.e., an oxide layer having a color different from the color of the underlying blade material, and methods of making such blades. The term "colored" as used herein, includes all colors, including black and white. The colored layer provides a desirable aesthetic effect, without deleteriously affecting the performance or physical properties of the blade. The color of the razor blades can be color-coordinated with the color of the housing of a razor cartridge or the handle or other components of a shaving system. In some preferred implementations, the layer covers substantially the entire blade surface, enhancing the aesthetic effect and simplifying manufacturing. The oxide layers described herein are durable, exhibit excellent adhesion to the blade material, and can be produced consistently and relatively inexpensively.

In one aspect, the invention features a razor blade for use in a wet shaving system, including a blade formed of a metallic sheet material and having a sharpened cutting edge, and a colored layer disposed on at least a portion of the blade.

The invention also features methods of producing colored layers. For example, in one aspect the invention features a method that includes subjecting a blade material to a hardening process; and, during the hardening process, oxidizing the blade material to form an oxide layer on the blade material. The method also includes quenching the blade material, after the oxidizing step, to initiate martensitic transformation of the blade material, and forming the hardened blade material into a razor blade, the oxide layer providing the razor blade with a colored surface. Preferred methods do not deleteriously affect the final properties of the blade.

Some methods may include one or more of the following features. The oxidizing step occurs after austenization of the blade material. The oxidizing step is conducted at a temperature of about 500 to 800° C. The hardening step includes reducing the temperature of the blade material from over 1100° C. during austenization to less than about 800° C. prior to the oxidizing step. Austenization of the blade material and the oxidizing step are conducted in separate chambers the ambient conditions of which can be independently controlled. The method further comprises controlling the ambient conditions under which the oxidizing step is performed. For example, the controlling step may include providing a chamber within which the oxidizing step is performed, and introducing one or more gases to the chamber during the oxidizing step. The gases may be selected from the group consisting of oxygen, mixtures of oxygen and nitrogen, nitrogen oxide, nitrogen dioxide, ozone ($O_3$), water vapor, and mixtures thereof. It is generally preferred that the chamber in which austenization occurs be sufficiently free of oxygen so that the blade material is substantially oxide-free when the oxidizing step begins. By "substantially oxide-free," we mean that the blade material has sufficiently little oxide on its surface so that a uniform oxidizing reaction, between the hydrogen, oxygen, and stainless steel surface can occur once the steel comes in contact with the oxygen as it enters the oxidation zone. In some implementations the chamber in which austenization occurs is substantially free of oxygen, i.e., contains less than about 500 ppm oxygen, preferably less than 100 ppm oxygen.

In some methods, the forming step includes sharpening the blade material to form a cutting edge. The forming step may also include breaking the slitted blade material into portions having substantially the same length as the razor blade.

The method may further include applying a coating to the cutting edge to enhance the shaving performance of the cutting edge. The coating may be selected, for example, from the group consisting of chromium containing materials, niobium containing materials, diamond coatings, diamond-like coatings (DLC), nitrides, carbides, oxides, and telomers.

In a further aspect, the invention features a wet shaving system that includes a razor including a blade formed of a metallic sheet material and having a sharpened cutting edge, the blade having a colored layer disposed on at least a portion of the blade. The blade may include any of the features discussed above.

The term "colored," as used herein, refers to a layer having a color that is different from the color of the substrate material prior to oxidization.

The details of one or more embodiments of the invention are set forth in the accompanying drawings and the description below. Other features and advantages of the invention will be apparent from the description and drawings, and from the claims.

DETAILED DESCRIPTION

Figure 1:
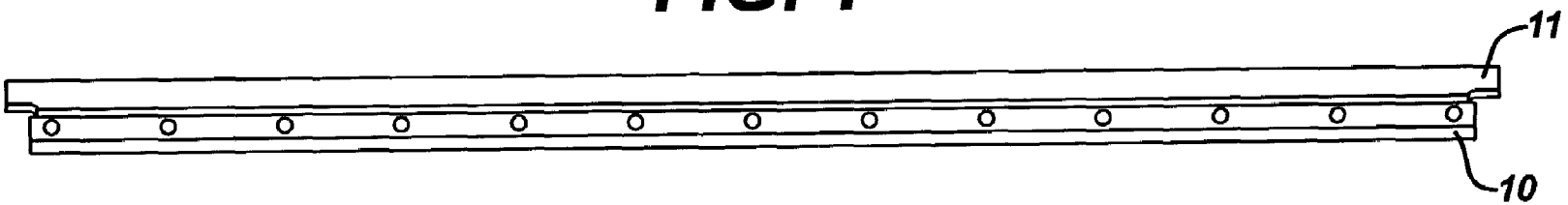
FIG. 1 is a top view.
Figure 1A:
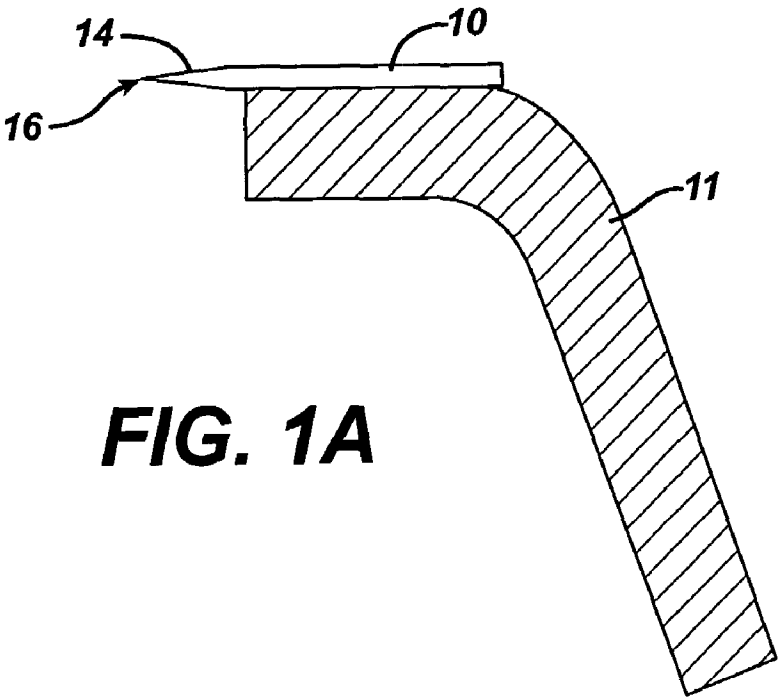
FIG. 1A is a side view of a supported razor blade.

Referring to FIGS. 1 and 1A, razor blade 10 includes a stainless steel substrate, which typically has a thickness of about 0.003 to 0.004 inch. The stainless steel has been hardened to its martensitic phase. The blade 10 has a cutting edge 14 (sometimes referred to as the "ultimate edge" of the blade) that has been sharpened to a tip 16. Preferably, tip 16 has a radius of less than 1,000 angstroms, preferably 200 to 400 angstroms, measured by SEM. Typically, tip 16 has a profile with side facets at an included angle of between 15 and 30 degrees, e.g., about 19 degrees, measured at 40 microns from the tip.

Blade 10 includes a very thin, e.g., 300 to 2000 Angstrom, colored layer. This layer is not visible in FIGS. 1 and 1A due to the scale of these figures. The colored layer is an oxide that is formed on the blade steel, as will be discussed below, so as to provide a desired color to the finished blade, and to withstand other blade processing steps without a deleterious color change or other damage or deterioration.

Figure 2:
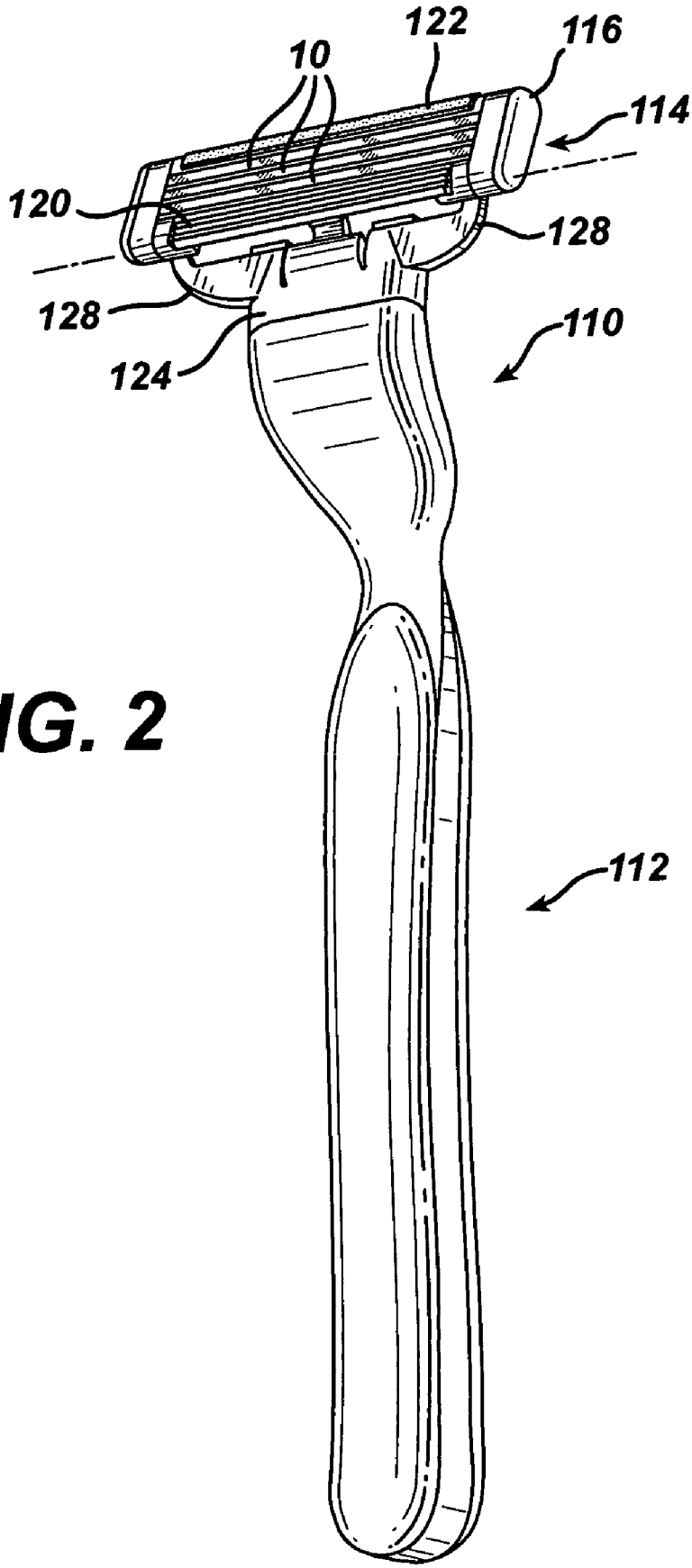
FIG. 2 is a perspective view of a shaving razor including the FIG. 1 razor blade.

Referring to FIG. 2, blade 10 can be used in shaving razor 110, which includes a handle 112 and a replaceable shaving cartridge 114. Cartridge 114 includes housing 116, which carries three blades 10, a guard 120 and a cap 122. Each blade 10 is welded to a support 11, and the blades 10 and their supports 11 are movably mounted, as described, e.g., in U.S. Pat. No. 5,918,369, which is incorporated herein by reference. Cartridge 114 also includes an interconnect member 124 on which housing 116 is pivotally mounted at two arms 128.

As discussed above, the color of the blade may be coordinated with the color of the housing or handle, or a portion of the housing or handle, to create a pleasing and distinctive aesthetic effect. For example, the color of the oxide layer may be the same as, and/or contrasting or complementary with the color(s) of the housing and/or handle. The color of the oxide layer may also be coordinated with that of elastomeric portions of the cartridge, e.g., the guard.

Blade 10 can be used in other types of razors, for example razors having one, two or three or more blades, or double-sided blades. Blade 10 can be used in razors that do not have movable blades or pivoting heads. The cartridge may either be replaceable or be permanently attached to a razor handle.

Figure 3:
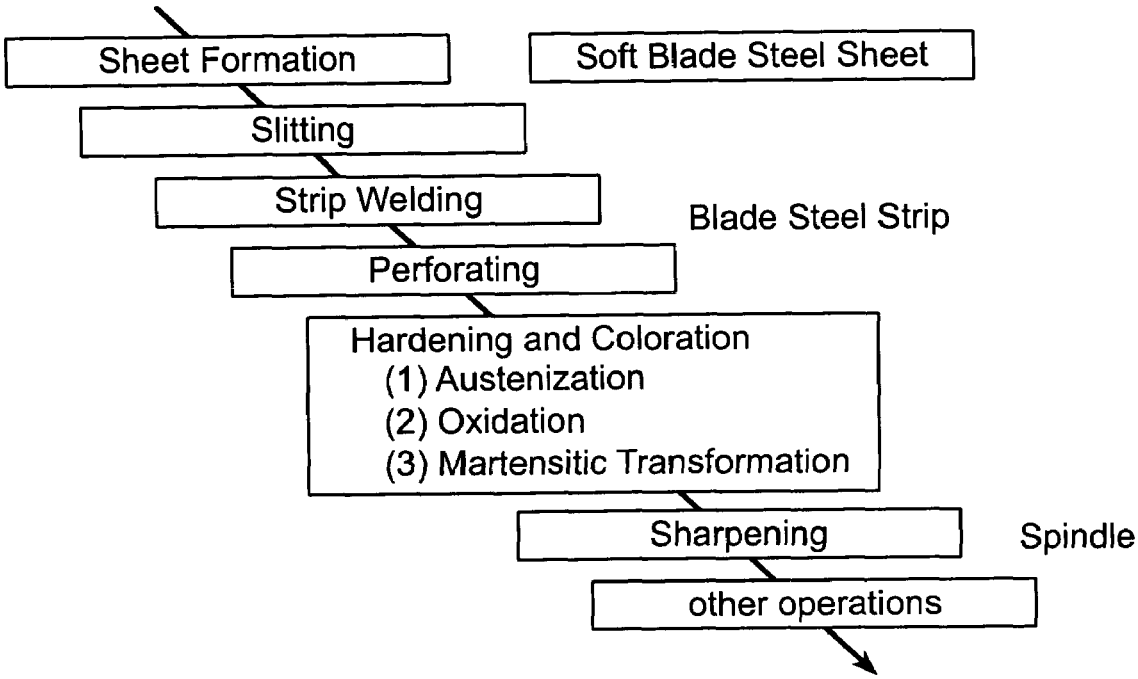
FIG. 3 is a flow diagram showing steps in a razor blade manufacturing process according to one embodiment of the invention.

A suitable process for forming the colored oxide layer and manufacturing the razor blade is shown diagrammatically in FIG. 3. First, a sheet of blade steel is slit into strips, and the strips are perforated for ease of handling during subsequent processing. Other pre-hardening steps, such as scoring, may be performed, if desired.

Figure 4:
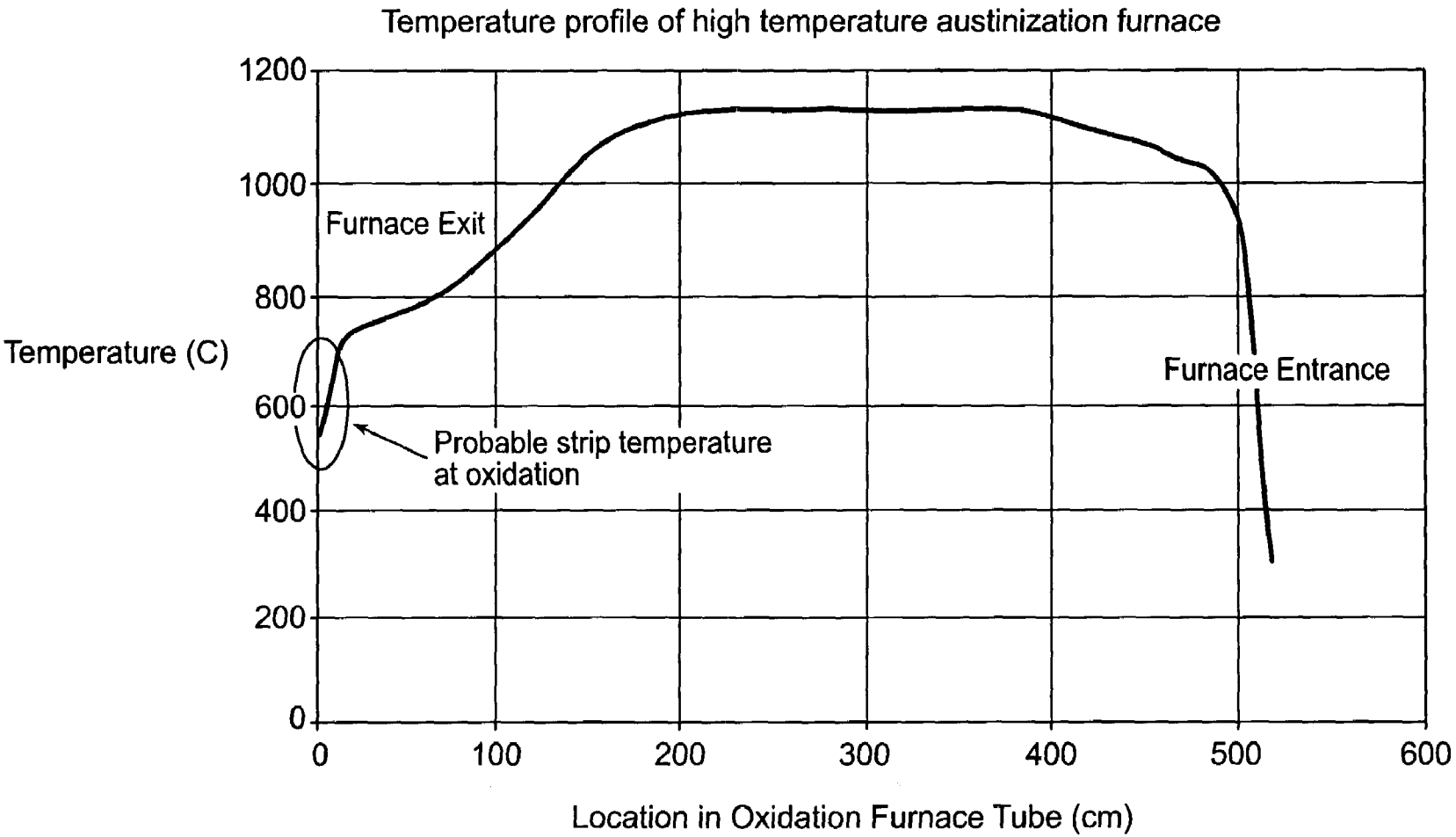
FIG. 4 is a temperature profile for a hardening furnace.

When the desired sequence of pre-hardening steps has been completed, the blade material is subjected to a hardening process, which includes austenitization of the stainless steel. A typical temperature profile for the hardening process, which is conducted in a tunnel oven, is shown in FIG. 4. The material is quickly ramped up to a high temperature, e.g., approximately 1160° C., maintained at this temperature for a period of time, during which austenization of the stainless steel occurs, and then allowed to cool. A Forming Gas (e.g., including hydrogen and nitrogen) flows through the high temperature zone of the oven during austenization. The composition and flow rate of the Forming Gas are controlled so that no oxidation occurs, and any native oxide is reduced. Preferably, the Forming Gas includes hydrogen, to prevent oxidation and reduce any native oxide, and nitrogen, as an inert gas used to dilute the over-all hydrogen concentration. For example, in some implementations the Forming Gas may include from about 50 to 100% hydrogen and from about 0 to 50% nitrogen, and may be delivered at a flow rate of from about 7 to 38 l/min.

After austenization, the strips pass through an oxidation zone, in which the colored oxide layer is grown on the surface of the blade steel. The Forming Gas flows from the hardening furnace into the oxidation zone. An Oxidation Gas (e.g., including oxygen) is introduced to the Forming Gas at a desired point in the oxidation zone (a point at which the strips have reached a temperature suitable for oxidation), and drives the oxidation process. The oxygen may be provided in the form of dry air. The oxidation zone and oxidation conditions (e.g., hydrogen to oxygen ratio) will be discussed in detail below. After the material exits the oxidization zone, it is rapidly quenched, resulting in a martensitic transformation of the stainless steel. Quenching does not deleteriously affect the color of the oxide layer.

The processes described herein may be added to existing blade steel hardening processes, often with minimal changes to the existing process. For example, one existing blade steel hardening process utilizes a high temperature furnace (greater than 1100° C.) containing a flowing Forming Gas. Two parallel continuous stainless steel blade strips are pulled through this high temperature furnace at 36.6 m/min (120 ft/min) each. This high temperature treatment is used to austenitize the stainless steel strips. Near the exit of the high temperature furnace is a water-cooled jacketed tube (also referred to as the water-cooled muffle tube). This section is used to start the cooling process of the stainless steel blade strips. Just after the water-cooled zone, the stainless steel blade strips are pulled through a set of water-cooled quench blocks. The quench blocks initiate the martensitic transformation of the steel. This existing process may be modified to form a colored oxide layer by replacing the water-cooled muffle tube, between the high temperature furnace and the quench blocks, with the oxidization zone referred to above. It is also preferred that the temperature profile of the furnace be modified so that the strips exit the furnace at a temperature less than 800° C., more preferably about 400 to 750° C., e.g., about 600-700° C.

Figure 5:
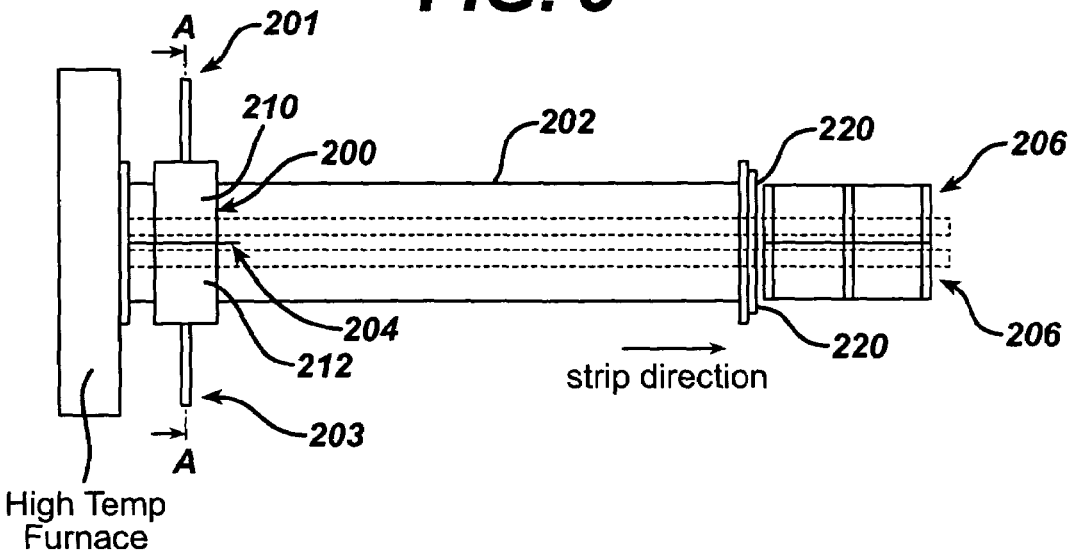
FIG. 5 is a diagrammatic side view of an oxidization zone.
Figure 5A:
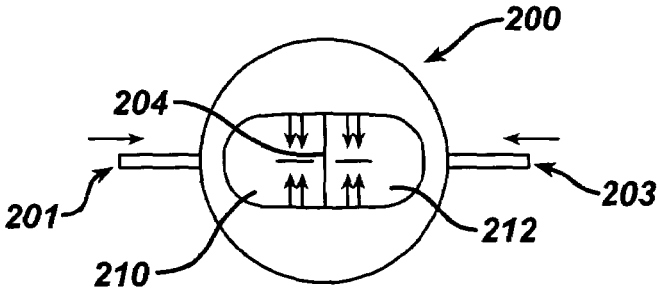
FIG. 5A is a diagrammatic cross-sectional view of a sparger, taken along line A-A in FIG. 5.
Figure 5B:
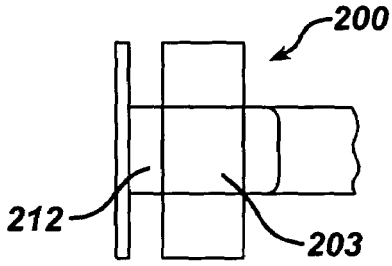
FIG. 5B is a side view of the sparger shown in FIG. 5A.
Figure 5C:
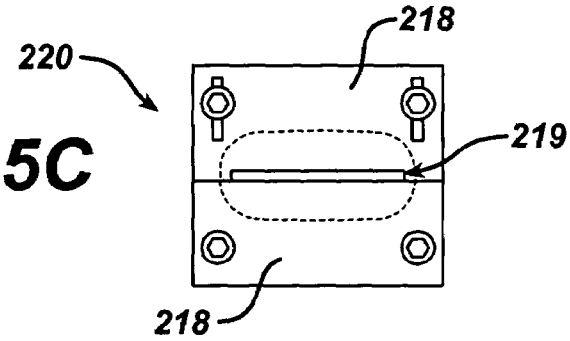
FIG. 5C is a front view of an exit gate used with the oxidation zone shown in FIG. 5.

A suitable oxidization zone is shown diagramatically in FIG. 5. The oxidation zone may be, for example, an Inconel tube attached to the tubing used in the high temperature furnace of the hardening line. Referring to FIG. 5, in one embodiment a gas sparger system 200 is installed about 2.9 cm from the entrance of the tube 202 and dimensioned to extend 5.1 cm down the tube. In this case, the sparger has a total of 16 inlet gas ports (not shown), and is designed so that gas injected through the sparger (arrows, FIG. 5A) will uniformly impinge upon the stainless steel strips. Gas is introduced to the sparger through a pair of inlet tubes 201, 203. A gas baffle 204 may be included so that the two stainless steel strips of blade material are separated from each other so that the gas composition on each side of the baffle may be independently controlled. The baffle 204 may define two chambers 210, 212, as shown in FIG. 5A. In this case, the gas baffle may, for example, begin 0.3 cm from the entrance of the oxidation zone and extend down the tube 10.2 cm. If desired, the gas baffle 204 may extend along the entire length of the oxidation zone so that there is no mixing of gas flows from inlet tubes 201 and 203, allowing for independent control to the two sides of the baffle within the tube (210 and 212). The gas sparger is designed so that dual gas flow control is possible, allowing two strips to be processed at the same time, using the same furnace. Gas flow rates may be controlled using gas flow meters. The exit of each chamber of the oxidation zone may be equipped with a flange and two pieces of steel 218 which define a slit 219 and thereby act as an exit gate 220 (FIG. 5C). The slit may be, for example, 0.1 to 0.2 cm wide. This exit gate prevents any back-flow of ambient air into the oxidation zone and also encourages better mixing of the gases within the oxidation zone. As discussed above, just after the oxidation zone, the stainless steel blade strips are pulled through a set of water-cooled quench blocks 206. The quench blocks initiate the martensitic transformation of the steel.

The desired color is generally obtained by controlling the thickness and composition of the oxide layer. The thickness and composition of the colored oxide layer will depend on several variables. For example, the thickness of the oxide layer will depend on the temperature of the stainless steel strip when the Oxidation Gas is introduced, and by the hydrogen-to-oxygen ratio of the mixture of Forming Gas and Oxidation Gas in the oxidation zone. The composition, or stoichiometry, of the oxide layer will depend on these same factors, and also on the morphology and surface composition of the strips. Generally, lower temperatures and flow rates will produce gold colors, and higher temperatures and flow rates will produce violet to blue colors. In some implementations, the hydrogen to oxygen ratio is from about 100:1 to 500:1. For a given type of blade material, with the hydrogen to oxygen ratio around the midpoint of this range, an aesthetic deep blue colored oxide will be obtained. Increasing the relative amount of oxygen will tend to result in light blue and light blue-green colors, while decreasing the relative amount of oxygen will tend to result in violet and then gold colors.

The speed at which the material travels through the oxidation zone and the length of the oxidation zone will also affect colorization. Suitable speeds may be, for example, in the range of 15 to 40 m/min.

In some cases, it may be necessary to adjust the process parameters of the hardening and/or oxidation process in order to obtain a consistent end product. The temperature of the strip as it enters the oxidation zone may be controlled by adjusting the temperature of the last zones in the hardening furnace, and/or by the use of heating elements in the oxidation zone. Increasing the temperature of the strip as it enters the oxidation zone will increase the oxide thickness produced in the oxidation zone. When the process is performed using most conventional furnaces, the temperature of the strip as it enters the oxidation zone can be adjusted only when first setting up the process. Since the gas composition of the Oxidizing Gas to the oxidation zone can be quickly adjusted, it is this parameter which is generally used to compensate for variations in the strip material and to fine-tune the oxide color. The exact temperature setting of the last zones of the hardening furnace and the exact composition of the Oxidizing Gas are selected based on, among other factors, the desired color, the size, shape, composition, and speed of the steel strip.

All of the processes described above allow a decorative oxide film to be grown on blade steel during the hardening process, after austenization and prior to the martensitic transformation. If, instead, the blade steel were colorized prior to the hardening process, the color would generally be degraded during the standard hardening process. If a thermal oxide coloration process were employed after the martensitic transformation, it would generally destroy the martensitic properties of the stainless steel strip. The processes described above generally provide highly adherent, protective oxides, while allowing excellent color control and without detrimentally impacting the metallurgic properties of the hardened stainless steel blade strips.

After the hardening process, the blade material is sharpened, to create the cutting edge shown in FIG. 1, and the strip of blade material is broken into blades of the desired length. The blades may then be welded, e.g., using laser welding, to the support 11 (FIG. 2), if such a support is to be used.

In addition to the colored layer, the razor blade may include other features, such as performance enhancing coatings and layers, which may be applied between the sharpening and welding steps.

For example, the tip may be coated with one or more coatings, as discussed in the Background section above. Suitable tip coating materials include, but are not limited to, the following:

Suitable interlayer materials include niobium and chromium containing materials. A particular interlayer is made of niobium having a thickness of from about 100 to 500 angstroms. PCT 92/03330 describes use of a niobium interlayer.

Suitable hard coating materials include carbon-containing materials (e.g., diamond, amorphous diamond or DLC), nitrides (e.g., boron nitride, niobium nitride or titanium nitride), carbides (e.g., silicon carbide), oxides (e.g., alumina, zirconia) and other ceramic materials. Carbon containing hard coatings can be doped with other elements, such as tungsten, titanium or chromium by including these additives, for example, in the target during application by sputtering. The hard coating materials can also incorporate hydrogen, e.g., hydrogenated DLC. DLC layers and methods of deposition are described in U.S. Pat. No. 5,232,568.

Suitable overcoat layers include chromium containing materials, e.g., chromium or chromium alloys that are compatible with polytetrafluoroethylene, e.g., CrPt. A particular overcoat layer is chromium having a thickness of about 100-500 angstroms.

Suitable outer layers include polytetrafluoroethylene, sometimes referred to as a telomer. A particular polytetrafluoroethylene material is Krytox LW 1200 available from DuPont. This material is a nonflammable and stable dry lubricant that consists of small particles that yield stable dispersions. It is furnished as an aqueous dispersion of 20% solids by weight and can be applied by dipping, spraying, or brushing, and can thereafter be air-dried or melt coated. The layer is preferably 100 to 5,000 angstroms thick, e.g., 1,500 to 4,000 angstroms. Provided that a continuous coating is achieved, reduced telomer coating thickness can provide improved first shave results. U.S. Pat. Nos. 5,263,256 and 5,985,459, which are hereby incorporated by reference, describe techniques which can be used to reduce the thickness of an applied telomer layer.

For example, the razor blade tip may include a niobium interlayer, a DLC hard coating layer, a chromium overcoat layer, and a Krytox LW 1200 polytetrafluoroethylene outer coat layer.

The following example is intended to be illustrative and not limiting in effect.

EXAMPLE

Strips of a stainless steel blade material were heat treated in a high temperature furnace using the hardening temperature profile shown in FIG. 4. The exit of the high temperature furnace was equipped with an oxidation zone of the type shown in FIG. 5. The temperature profile of the high temperature furnace, as well as the gas ambient of the high temperature furnace, was controlled. The temperature in the high temperature furnace was set at 1160° C.

To obtain deep blue (minimum reflectivity between 640 nm and 660 nm), the last heated zone of the austenization (high temperature) furnace was lowered to a temperature of 740° C. The entry heated zone temperature, usually set near 1000° C., was increased to 1145° C., to maintain the desired length of higher temperatures within the furnace to obtain the correct amount of austenization. The oxidation zone was attached directly to the exit of the high temperature furnace (including high temperature gasket material). The water-cooled quench blocks (water temperature maintained at 32° C.) were nearly touching the exit of the oxidation zone. The Forming Gas flow rate into the entrance of the high temperature furnace was set at 18.9 L/min (40 scfh). The Oxidation Gas was introduced near the entry end of the oxidation zone as a mixture of air (0.45 L/min) and nitrogen (2.0 L/min). Two stainless steel blade strips were running through the furnace at 36.6 m/min (120 ft/min). The air flow rate was either increased or decreased to "dial-in" the desired oxide color.

To obtain a different color selection, the temperature of the last zone of the high temperature furnace was raised and lowered. The air flow rate was also modified to fine tune both the desired color and the color uniformity. The colors obtained ranged from, beginning with lower temperature and/or lower air flow rate and increasing the temperature and/or air flow rate: "straw" (light gold), to gold, to pink-gold, to deep blue (violet), to blue, to light blue. For lower temperatures and air flow rates ($T_{set}$=700° C., air flow at 0.30 L/min), "gold colors" were obtained. For higher temperatures and air flow rates ($T_{set}$=740° C., air flow at 0.45 L/min), "blues" were obtained.

Other embodiments are within the scope of the following claims.

What is claimed is:

1. A method of manufacturing a razor blade comprising;

a. subjecting a continuously moving, stainless steel blade material to a high temperature hardening process wherein said hardening process comprising the sequential steps of 1) ramping said blade material up to said high temperature upon entrance to a furnace;

2) austenizing said blade material by maintaining said blade material at said high temperature for a period of time in said furnace through which a forming gas flows;

3) lowering the temperature of said blade material prior to oxidation and prior to exiting said furnace through which said forming gas is flowing;

4) immediately oxidizing the blade material to form an uniform oxide layer on the blade material;

b. quenching the blade material, after the oxidizing step, to initiate martensitic transformation to harden the blade material; and c. forming the hardened blade material into a razor blade, the oxide layer providing the razor blade with a colored surface.

2. The method of claim 1 wherein the oxidizing step is conducted at a temperature of from about 400 to 800° C.

3. The method of claim 1 or 2 wherein the step of lowering the temperature includes reducing the temperature of the blade material to less than about 800° C. at the conclusion of austenization.

4. The method of claim 3 wherein the austenizing step and the oxidizing step are conducted in separate chambers, the ambient conditions of which can be independently controlled.

5. The method of claim 3 further comprising controlling the ambient conditions during the austenizing step so that the blade material is substantially oxide-free when the oxidizing step begins.

6. The method of claim 1 further comprising controlling the ambient conditions under which the oxidizing step is performed.

7. The method of claim 6 wherein the controlling step includes providing a chamber within which the oxidizing step is performed, and introducing one or more gases to the chamber during the oxidizing step.

8. The method of claim 7 wherein the gas introduced to the chamber comprises hydrogen.

9. The method of claim 7 wherein the gases introduced to the chamber include a mixture of hydrogen with an oxidizing gas.

10. The method of claim 9 wherein the oxidizing gas is selected from the group consisting of oxygen, nitrogen oxide, nitrogen dioxide, ozone, and water vapor.

11. The method of claim 9 wherein the oxidizing gas is mixed with an inert carrier gas.

12. The method of claim 11 further comprising selecting or adjusting the oxidizing gas concentration to target and control a specific color of the oxide layer.

13. The method of claim 12 wherein the oxidizing gas composition is adjusted by varying the flow rate of the oxidizing gas, in a steady stream of the inert carder gas, to the chamber where the oxidizing step occurs.

14. The method of claim 13 wherein the oxidizing gas is dry air and the carrier gas is dry nitrogen.

15. The method of claim 1 wherein the forming step includes sharpening the blade material to form a cutting edge.

16. The method of claim 15 further comprising applying a coating to the cutting edge to enhance the shaving performance of the cutting edge.

17. The method of claim 16 wherein the coating is selected from the group consisting of chromium containing materials, niobium containing materials, diamond coatings, diamond-like coatings (DLC), nitrides, carbides, oxides, and telomers.

18. The method of claim 1 wherein the forming step comprises breaking the blade material, has have been previously slitted. into portions having substantially the same length as the razor blade.

* * * * *

UNITED STATES PATENT AND TRADEMARK OFFICE

CERTIFICATE OF CORRECTION

PATENT NO. : 7,284,461 B2
APPLICATION NO. : 11/013827
DATED : October 23, 2007
INVENTOR(S) : Kenneth J. Skrobis et al.

It is certified that error appears in the above-identified patent and that said Letters Patent is hereby corrected as shown below:

Column 1

Line 16, delete "110° C." and insert --1100° C.--.

Column 8

Line 1, delete "an" and insert --a--.

Line 45, delete "carder" and insert --carrier--.

Line 61, delete "has have" and insert --which has--.

Signed and Sealed this

First Day of July, 2008

JON W. DUDAS
*Director of the United States Patent and Trademark Office*